US009494346B2

(12) United States Patent
Xu et al.

(10) Patent No.: US 9,494,346 B2
(45) Date of Patent: Nov. 15, 2016

(54) CRYOGENIC REFRIGERATOR

(75) Inventors: Mingyao Xu, Tokyo (JP); Takaaki Morie, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 501 days.

(21) Appl. No.: 13/616,453

(22) Filed: Sep. 14, 2012

(65) Prior Publication Data

US 2013/0086925 A1 Apr. 11, 2013

(30) Foreign Application Priority Data

Oct. 5, 2011 (JP) ..... 2011-221266

(51) Int. Cl.
*F25B 9/00* (2006.01)
*F25B 9/14* (2006.01)
*F25B 9/10* (2006.01)

(52) U.S. Cl.
CPC . *F25B 9/14* (2013.01); *F25B 9/10* (2013.01); *F25B 2500/01* (2013.01)

(58) Field of Classification Search
CPC .. F25B 9/01; F25B 2309/001; F25B 53/008; F25B 53/02; F25B 9/14
USPC ..... 62/6; 95/145, 181 R
See application file for complete search history.

(56) References Cited

U.S. PATENT DOCUMENTS 3,296,817 A * 1/1967 Stoelting ..... 62/225
5,447,034 A * 9/1995 Kuriyama ..... F16J 9/062 148/301
5,481,879 A * 1/1996 Asami ..... F25B 9/14 60/520
2010/0229572 A1* 9/2010 Raiju et al. ..... 62/6
2013/0008184 A1 1/2013 Matsubara et al.

FOREIGN PATENT DOCUMENTS

| | | |
|---|---|---|
| CN | 101900447 | 12/2010 |
| JP | 05-079358 U | 10/1993 |
| JP | 11-173697 | 7/1999 |
| JP | 2004-144461 | 5/2004 |
| JP | 2008-224061 | 9/2008 |
| JP | 2011-017457 | 1/2011 |
| WO | WO 2011/115201 | 9/2011 |
| WO | WO 2012/027918 | 3/2012 |

OTHER PUBLICATIONS

JP2004-144461 Translation.*

* cited by examiner

*Primary Examiner* — Frantz Jules
*Assistant Examiner* — Brian King
(74) *Attorney, Agent, or Firm* — IPUSA, PLLC

(57) ABSTRACT

A disclosed device cryogenic refrigerator includes a first stage displacer; a first stage cylinder configured to form a first expansion space between the first stage cylinder and the first stage displacer; a second stage displacer connected to the first stage displacer; and a second stage cylinder configured to form a second expansion space between the second stage cylinder and the second stage displacer, wherein the second stage displacer includes a helical groove formed on an outer peripheral surface of the second stage displacer so as to helically extend from the second expansion space, a flow resistor communicating with a side of the first stage displacer in the helical groove, and a flow path connecting the flow resistor to a side of the first expansion space, wherein the flow resistor is always positioned on a side of the second expansion space relative to the first expansion space.

4 Claims, 4 Drawing Sheets

CRYOGENIC REFRIGERATOR

CROSS-REFERENCE TO RELATED APPLICATIONS

This patent application is based upon and claims the benefit of priority of Japanese Patent Application No. 2011-221266 filed on Oct. 5, 2011 the entire contents of which are incorporated herein by reference.

BACKGROUND OF THE INVENTION

1. Field of the Invention

The present invention generally relates to a cryogenic refrigerator which generates cold (a cold thermal energy by causing an ultra-low temperature) by generating Simon expansion using a high-pressure refrigerant gas supplied from a compression device.

2. Description of the Related Art

For example, the Patent Document 1 discloses a Gifford-McMahon (GM) refrigerator causing a gas existing inside a gap between a piston of the GM refrigerator and a cylinder of the GM refrigerator to expand. This GM refrigerator has a linear groove functioning as a phase shifting mechanism. [Patent Document 1] Chinese Laid-open Patent Publication No. 101900447A

SUMMARY OF THE INVENTION

According to an aspect of the present invention, there is provided a regenerative type refrigerator including: a first stage displacer; a first stage cylinder configured to form a first expansion space between the first stage cylinder and the first stage displacer; a second stage displacer connected to the first stage displacer; and a second stage cylinder configured to form a second expansion space between the second stage cylinder and the second stage displacer, wherein the second stage displacer includes a helical groove formed on an outer peripheral surface of the second stage displacer so as to helically extend from the second expansion space, a flow resistor communicating with a side of the first stage displacer in the helical groove, and a flow path connecting the flow resistor to a side of the first expansion space, wherein the flow resistor is always positioned on a side of the second expansion space relative to the first expansion space.

DETAILED DESCRIPTION OF THE PREFERRED EMBODIMENTS

According to the above structure disclosed in the Patent Document 1, a high temperature side of the linear groove repeatedly enters into and exits from an expansion space on a side of a first stage while a two-stage type displacer reciprocates. Therefore, the flow path resistance of a flow resistor changes. Therefore, there is a problem that refrigeration efficiency is not enhanced.

The object of the embodiments of the present invention is to provide a cryogenic refrigerator which can effectively enhance refrigeration efficiency solving one or more of the problems discussed above.

Preferred embodiments of the present invention are explained next with reference to accompanying drawings.

First Embodiment

Figure 1:
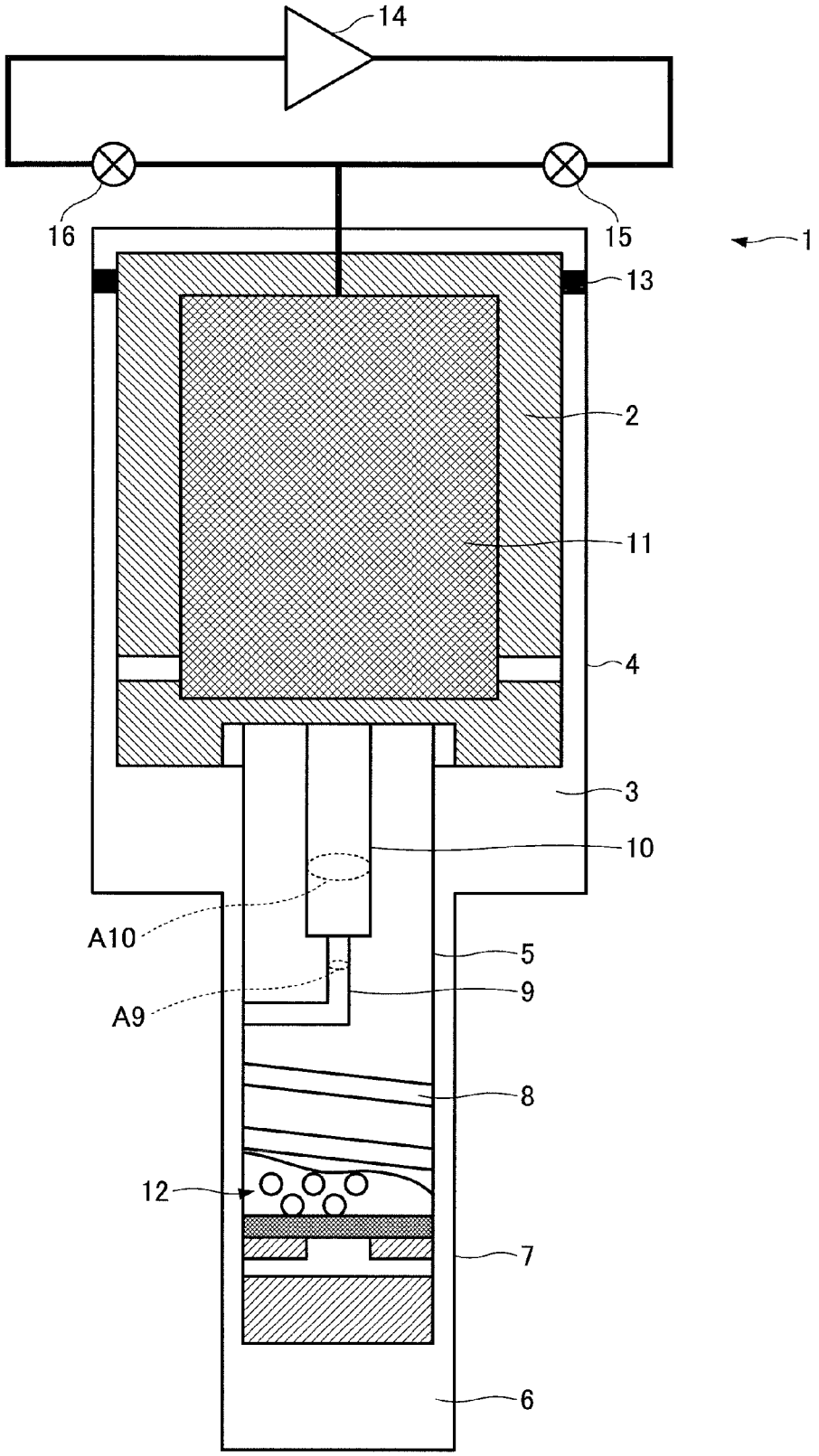
FIG. 1 schematically illustrates an exemplary cryogenic refrigerator of a first embodiment.

A cryogenic refrigerator 1 of the first embodiment may be of a Gifford-McMahon (GM) type. Referring to FIG. 1, the cryogenic refrigerator 1 includes a first stage displacer 2, a first stage cylinder 4 forming a first expansion space 3 between the first stage cylinder 4 and the first stage displacer 2, a second stage displacer 5 connected to the first stage displacer 2, and a second stage cylinder 7 forming a second expansion space 6 between the second stage cylinder 7 and the second stage displacer 5.

Further, the cryogenic refrigerator 1 includes a helical groove 8 formed on an outer peripheral surface of the second stage displacer 5 and helically extends from the second expansion space 6, a flow resistor 9 communicating with a side of the first stage displacer 2 in the helical groove 8, and a flow path 10 communicating with a side of the first expansion space 3 in the flow resistor 9. The flow resistor 9 is always positioned on a side of the second expansion space 6 relative to the first expansion space 3.

The first stage displacer 2 and the second stage displacer 5 have cylindrical outer peripheral surfaces, respectively. A first regenerator 11 is provided inside the first stage displacer 2. A second regenerator 12 is provided in the second stage displacer 5. A sealing portion 13 is provided between a portion on the high temperature side of the first stage displacer 2 and the first stage cylinder 4. A supply and discharge pipe is connected to the upper end of the first stage cylinder 4. The supply and discharge pipe is included in pipes for connecting various parts of a supply and discharge system such as a compressor 14, a supply valve 15, and a return valve 16.

An axis member (not illustrated) is connected to the upper end of the first stage displacer 2. The axis member protrudes from the upper end of the first stage cylinder 4 and is connected to a driving motor (not illustrated) via a crank mechanism (not illustrated). The axis member, the crank mechanism, and the driving motor form a driving mechanism for reciprocating the first stage displacer 2 and the second stage displacer 5 in the axial directions.

The first stage displacer 2 is accommodated in the first stage cylinder 4, which is shaped like an upside down bottomed cylinder (a capped cylinder) having an opened lower end. The second stage displacer 5 is accommodated inside the second stage cylinder 7, which is shaped like an upside down bottomed cylinder (a capped cylinder) having an opened lower end. The first stage cylinder 4 and the second stage cylinder 7 are integrally formed.

For example, stainless steel may be used as a material of the first and second stage cylinders 4 and 7 to achieve high strength, low thermal conductivity, and sufficient helium interruption capability. For example, a phenol resin including fabric or the like is used for the first stage displacer 2 to obtain a lighter specific gravity, more sufficient wear resistance, higher strength, and lower thermal conductivity. The second stage displacer 5 is a metallic cylinder on the outer periphery of which a coating such as fluorine contained resin having high wear resistance is provided. The first regenerator 11 is formed of a first regenerative material such as a screen. The second regenerator 12 is formed by holding a regenerative material such as lead spheres in the axial directions by felt and screens.

The helical groove 8 is formed on the outer peripheral surface of the second stage displacer 5. The helical groove 8 has a start end communicating with the second expansion space 6, helically extends toward the side of the first expansion space 3, and has a final end ending at a middle position in the axial direction of the second stage displacer 5.

Further, the flow resistor 9 in a groove-like shape is formed on the outer peripheral surface of the second stage displacer 5 so as to extend from the end of the helical groove 8 in an axial direction (a longitudinal direction) of the second stage displacer 5. Referring to FIG. 1, the end of the flow resistor 9 is positioned lower than the bottom of the first stage cylinder 4 when the first stage displacer 2 and the second stage displacer 5 are positioned at their upper dead centers. A flow path 10 is further formed on the outer peripheral surface of the second stage displacer 5 and extends from the end of the flow resistor 9 to the top of the second displacer 5 so as to communicate with the first expansion space 3.

As described, the flow resistor 9 always exists on the side of the second expansion space 6 relative to the first expansion space 3. When the first stage displacer 2 is positioned at the upper dead center where the first expansion space 3 becomes maximum, the flow resistor 9 is entirely positioned on the side of the second expansion space 6 relative to an exposing portion of the outer peripheral surface of the second stage displacer 5 exposed to the first expansion space 3. Referring to FIG. 1, the upper end of the flow resistor 9 is positioned below the bottom of the first cylinder 4 forming the first expansion space 3.

The flow path 10 is formed on the outer peripheral surface of the second stage displacer 5 so as to extend in the axial direction of the second stage displacer 5. A cross-sectional area A10 (a corresponding area is indicated by a dashed oval in FIG. 1) of the flow path 10 in a cross-sectional view perpendicular to the axial direction is greater than a cross-sectional area A9 (a corresponding area is indicated by a dashed oval in FIG. 1) of the flow resistor 9 in a cross-sectional view perpendicular to a direction of extending the flow resistor 9 (A10>A9).

When the compressor 14 is operated and the supply valve 15 is opened, a high pressure helium gas is supplied from the above supply and discharge pipe into the first stage cylinder 4 via the supply valve 15. The high pressure helium gas is further supplied to the first expansion space 3 via a communicating passage for communication of the refrigerant gas between an upper end inside the first stage displacer 2 and the first regenerator 11 and a communicating passage for communication of the refrigerant gas between the first regenerator 11 and the first expansion space 3.

The high pressure helium gas supplied to the first expansion space 3 is further supplied to the second regenerator 12 via a communicating passage for communication of the refrigerant gas between the first expansion space 3 and the second regenerator 12, and is supplied to the second expansion space 6 via a communicating passage for communication of the refrigerant gas between the second regenerator 12 and the second expansion space 6. A part of the high pressure helium gas other than that supplied to the first expansion space 3 is supplied to the high pressure side of the helical groove via the flow path 10 and the flow resistor 9 formed on the outer peripheral surface of the second displacer 5 as a gas passage. A part of the high pressure helium gas supplied to the second expansion space 6 is supplied to a low temperature side inside the helical groove 8.

Figure 2:
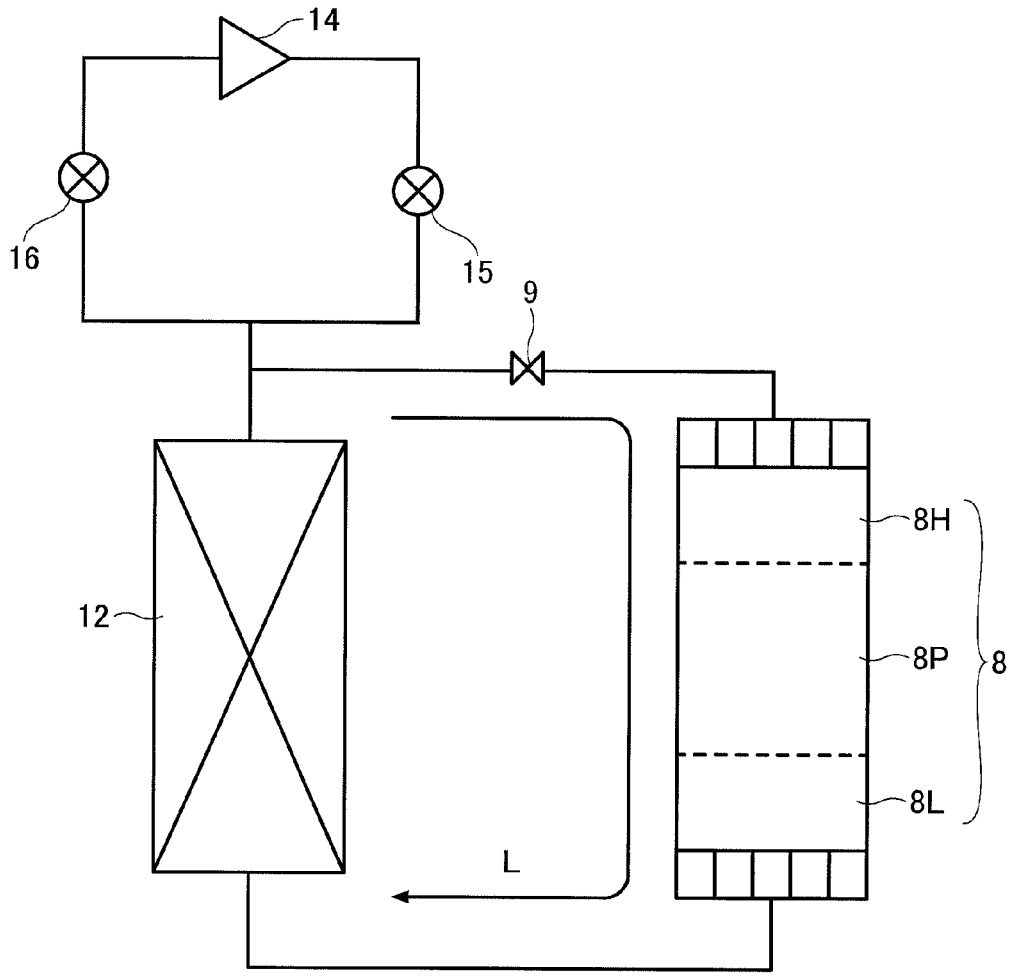
FIG. 2 schematically illustrates a flow of a gas in which a side clearance of the cryogenic refrigerator is regarded as a pulse tube of a virtual pulse tube refrigerator.

FIG. 2 schematically illustrates a flow of a gas in which a side clearance of the cryogenic refrigerator is regarded as a pulse tube of a virtual pulse tube refrigerator. The flow resistor 9 corresponds to an orifice arranged on a communicating passage connecting the supply and discharge pipe to the high pressure side of the helical groove 8. The refrigerant gas inside the helical groove 8 corresponds to a virtual gas piston 8P (a substantially center portion of the helical groove 8 in the axial direction).

The length of the virtual gas piston 8P in the axial direction and the phase of the virtual gas piston 8P may be adjusted so that the virtual gas piston 8P is always accommodated inside the helical groove 8 during reciprocation of the helical groove 8 and so that a high temperature side space 8H exists on the high temperature side of the virtual gas piston 8P and a low temperature side space 8L exists on the low temperature side of the virtual gas piston 8P. The length of the virtual gas piston 8P in the axial direction and the phase of the virtual gas piston 8P are adjusted by changing the cross-sectional area and the length of the flow resistor (the orifice) 9 functioning as a phase shifting mechanism.

Next, the operation of the refrigerator is described. At a certain time point of supplying the refrigerant gas, the first stage displacer 2 and the second stage displacer 5 are positioned at lower dead centers in the first stage cylinder 4 and the second stage cylinder 7, respectively. At this timing or a timing slightly different from this timing, the supply valve 15 is opened. Then, a high pressure helium gas is supplied inside the first stage cylinder 4 from a supply and discharge pipe via the supply valve 15. The high pressure helium gas flows inside the first stage displacer 2 (into the first regenerator 11) from an upper portion of the first stage displacer 2. The high pressure helium gas flowing inside the first regenerator 11 is supplied into the first expansion space 3 via the communicating passage positioned at the lower portion of the first stage displacer 2 while being cooled by the first regenerative material.

Most of the high pressure helium gas supplied to the first expansion space 3 is then supplied to the second regenerator 12 via a communication passage (not illustrated). The residual helium gas which is not supplied to the second regenerator 12 is supplied from the high temperature side to the helical groove 8 via the flow path 10 and the flow resistor 9. This gas corresponds to the helium gas existing in the high temperature side space 8H in FIG. 2, which functions to prevent the virtual gas piston 8P from flowing toward the first expansion space 3 from the helical groove 8. Because the cross-sectional area of the flow path 10 is sufficiently greater than the cross-sectional area of the flow resistor 9, the resistance of the helium gas in flowing through the flow path 10 is substantially smaller than the resistance of the helium gas on flowing through the flow resistor 9. Therefore, the inflow resistance of the helium gas flowing from the first expansion space 3 to the high temperature side space 8H can be adjusted by changing the total length and the cross-sectional area of the flow resistor 9.

The high pressure helium gas flowing into the second regenerator 12 is cooled by the second regenerative material inside the second regenerator and is supplied to the second expansion space 6. A part of the high pressure helium gas supplied to the second expansion space 6 is supplied into the low temperature side helical groove 8 from the low temperature side. This gas corresponds to the helium gas existing inside the low temperature side space 8L in FIG. 3.

As described, since the cross-sectional area of the flow resistor 9 is smaller the than cross-sectional area of the helical groove 8, the inflow resistance of the helium gas flowing into the high temperature side space 8H (flowing inside the helical groove 8) is greater than the inflow resistance of the helium gas flowing into the low temperature side space 8L (inside the helical groove 8). Therefore, the amount of the helium gas flowing inside the high temperature side space 8H is smaller than the amount of the helium gas flowing inside the low temperature side space 8L thereby preventing the gas in the high temperature side space 8H from flowing into the second expansion space 6.

As described, the first expansion space 3, the second expansion space 6 and the helical groove 8 are filled with the high pressure helium gas and the supply valve 15 is closed. At this time, the first stage displacer 2 and the second stage displacer 5 are positioned at the upper dead centers in the first stage cylinder 4 and the second stage cylinder 7, respectively. At this timing or a timing slightly different from this timing, the return valve 16 is opened. Then, the refrigerant gas inside the first expansion space 3, the second expansion space 6 and the helical groove 8 are depressurized to thereby expand. The helium gas inside the first expansion space 3 having a low temperature by the expansion absorbs heat of a first cooling stage (not illustrated) and the helium gas in the second expansion space 6 absorbs heat of a second cooling stage (not illustrated).

The first stage displacer 2 and the second stage displacer 5 move toward the lower dead centers thereby reducing the volumes of the first expansion space 3 and the second expansion space 6. The helium gas inside the second expansion space 6 is recovered into the first expansion space 3 via the second regenerator 12. The helium gas on the low temperature side space 8L in the helical groove 8 is recovered via the second expansion space 6.

The helium gas in the first expansion space 3 returns to the compressor 14 via the first regenerator 11 to a suction side of the compressor 12. At this time, the first regenerative material and the second regenerative material are cooled by the refrigerant gas. These processes form one cycle. The first cooling stage and the second cooling stage are cooled by repeating the cycle.

The following functions and effects are obtainable by the cryogenic refrigerator 1 of the first embodiment. The virtual gas piston 8P is realized inside the helical groove 8 forming the side clearance between the second stage displacer 5 and the second stage cylinder 7 to cause the gas piston 8P to function as the sealing portion for preventing the helium gas from communicating between the high and low temperature sides of the side clearance.

Said differently, the virtual gas piston realized by using the side clearance between the outer peripheral surface of the second displacer 5 and the inner peripheral surface of the second stage cylinder 7 prevents the helium gas from bi-directionally moving thereby preventing generation of leakage loss. Thus, the refrigeration efficiency can be enhanced.

Additionally, the side clearance can be regarded as the virtual pulse tube refrigerator due to the virtual gas piston 8P. Then, it is possible to use the low temperature side space 8L on the low temperature side of the gas piston 8P as a third expansion space. Thus, it is possible to enhance refrigeration efficiency.

Further, a double inlet forming the phase shifting mechanism for adjusting the length of the virtual gas piston 8P in the axial direction and the phase of the virtual gas piston 8P is realized by the first flow resistor 9 in a groove-like shape extending in the axial direction on the outer peripheral surface of the second stage displacer 5. Therefore, the phase shifting mechanism can be further easily formed. Further, the flow resistor 9 is formed so as not to enter into the first expansion space 3 regardless of the above reciprocation of the first stage displacer 2 and the second stage displacer 5. Therefore, the flow rate coefficient as the double inlet is constant along the entire region of the reciprocation to thereby stabilize a phase shifting function.

Within the first embodiment, it is possible to stabilize a phase shifting function. Therefore, it is possible to stabilize the length and the phase of the virtual gas piston 8P and the above described function of the sealing portion. The leakage loss can be further secured. Furthermore, the refrigeration efficiency can be further securely enhanced by providing the third expansion space.

Although the flow resistor 9 extends in the axial direction on the outer peripheral surface of the second stage displacer 5, the flow resistor 9 may instead be a hole communicating with the end of the helical groove 8 by downwardly extending from the start end of the flow path 10.

Second Embodiment

In the above cryogenic refrigerator 1 of the first embodiment, the high pressure helium gas flows from the first expansion space 3 to the helical groove 8 through the flow path 10 and the flow resistor 9. The low pressure helium gas flows from the helical groove 8 to the first expansion space 3. Said differently, the refrigerant gas bi-directionally flows through the flow resistor 9 functioning as the double inlet. Since a high pressure helium gas has a density higher than that of a low pressure helium gas, the high pressure helium gas has a smaller flow velocity and a smaller pressure loss than the low pressure helium gas. Therefore, the amount of the high pressure helium gas flowing through the flow resistor per cycle is slightly greater than the amount of the low pressure helium gas flowing through the high pressure helical groove 8 per cycle. Therefore, the gas flow rates in the bi-directional flows are not balanced. As a result, a steady-state flow directed from the high temperature side of the helical groove 8 to the low-temperature side of the helical groove 8 may be generated every time the cooling cycles are repeated. Referring to FIG. 2, this flow is a secondary flow along an arrow L in a clockwise direction.

Figure 3A:
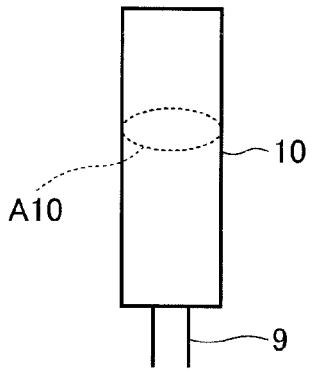
FIGS. 3A and 3B schematically illustrate exemplary cryogenic refrigerators of a second embodiment.
Figure 3B:
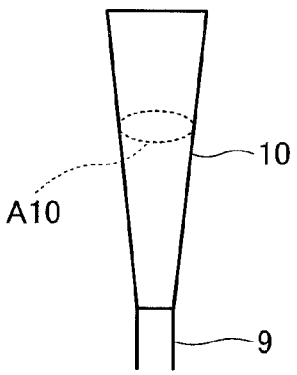

Within the second embodiment, the constant cross-sectional area A10 (a corresponding area is indicated by a dashed oval in FIG. 3A) of the flow path 10 in the extending direction in FIG. 3A of the first embodiment is changed to a continuously increasing cross-sectional area starting from the flow resistor 9 as illustrated in FIG. 3B of the second embodiment. Referring to FIG. 3B, the cross-sectional area A10 (a corresponding area is indicated by a dashed oval in FIG. 3B) of the flow path 10 is adjusted by changing the width perpendicular to the radius direction of the second stage displacer 5. However, the depth in the radius direction may be adjusted alone or in addition to the adjustment of the width.

Thus, it is possible to give a resistance of preventing generation of a secondary flow to a flow of the helium gas by reducing the cross-sectional area A10 of the flow path 10. The flow path resistance of the helium gas caused when the helium gas flows from the first expansion space 3 through the flow resistor 9 to the helical groove 8 is greater than the flow path resistance of the helium gas caused when the helium gas flows from the helical groove 8 through the flow resistor 9 to the first expansion space 3 thereby restricting the generation of the secondary flow. Therefore, a heat loss caused by the secondary flow L can be prevented to thereby enhance refrigeration efficiency.

Third Embodiment

The third embodiment is described in detail. Within the first and second embodiments, the flow path 10 is provided on the outer peripheral surface of the second displacer 5. However, the flow path 10 may be arranged along the radius direction of the second displacer 5.

Figure 4:
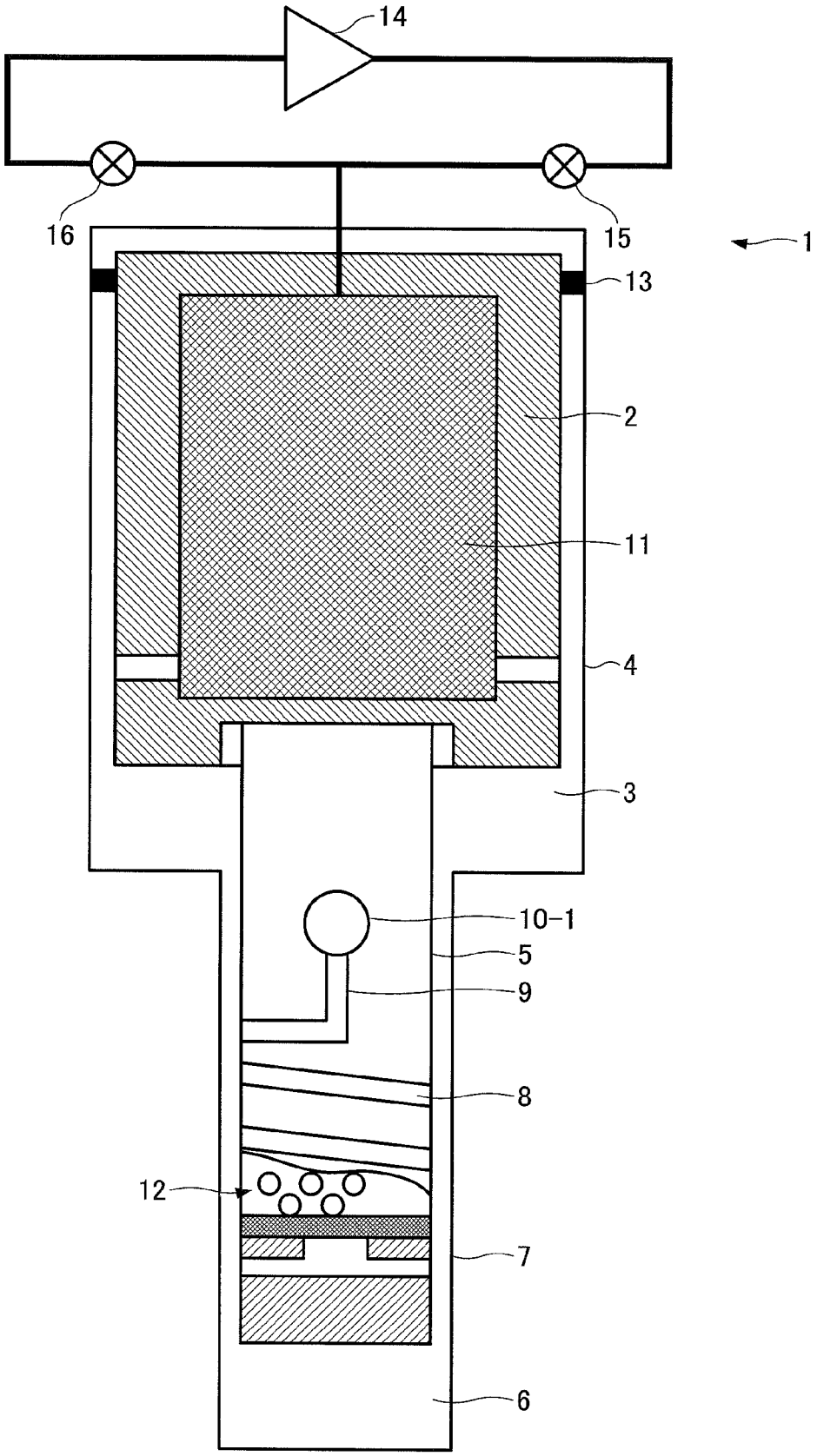
FIG. 4 schematically illustrates an exemplary cryogenic refrigerator of a third embodiment.

Except for a flow path 10-1, a cryogenic refrigerator 1 of the third embodiment has a structure basically similar to that of the first embodiment. Therefore, the same reference symbols are applied to the same portions and description of the different portions are mainly described. Referring to FIG. 4, the cryogenic refrigerator 1 of the third embodiment includes a helical groove 8 formed on an outer peripheral surface of a second stage displacer 5 and helically extends from a second expansion space 6, a flow resistor 9 communicating with the helical groove 8 on a side of the first stage displacer 2, and the flow path 10-1 connecting the flow resistor 9 to a first expansion space 3. The flow resistor 9 is always positioned inside the second stage cylinder 7 relative to the first expansion space 3.

Within the third embodiment 3, the flow resistor 9 is shaped like a groove extending on the outer peripheral surface of the second stage displacer 5 in the axial direction. Referring to FIG. 4, the upper end of the flow resistor 9 is always positioned lower than a first expansion space 3, namely around the bottom portion of the first stage cylinder 4.

Within the third embodiment, in a manner similar to the first embodiment, the helical groove 8 forming the side clearance between the outer peripheral surface of the second stage displacer 5 and the inner peripheral surface of the second stage cylinder 7 is regarded as a pulse tube refrigerator as illustrated in FIG. 2 to form the virtual gas piston 8P inside the helical groove 8. Then, the flow resistor 9 having a constant flow rate coefficient is regarded as the double inlet of which phase and length are appropriately adjustable.

Said differently, it becomes possible to enhance refrigeration efficiency by securely providing a sealing function to the virtual gas piston 8P to thereby prevent a leakage loss. Further, the refrigeration efficiency can also be enhanced by additionally cooling using a low temperature side space 8L of the helical groove 8 as a third expansion space.

Further, the helium gas flowing inside the high temperature side space 8H flows via the second regenerator 12. Therefore, the refrigerant gas cooled to have a lower temperature than that in the first embodiment preferably flows into the helical groove 8.

Fourth Embodiment

Within the above first to third embodiments, the flow resistor 9 extends on the outer peripheral surface in the axial direction as the groove. A flow path may be formed by a hole extending in the radius direction of the second stage displacer 5 so that the hole functions as a flow resistor. The fourth embodiment is described next.

Except for a flow path 10-2, a cryogenic refrigerator 1 of the fourth embodiment has a structure basically similar to that of the third embodiment. Therefore, the same reference symbols are applied to the same portions and description of the different portions are mainly described.

Figure 5:
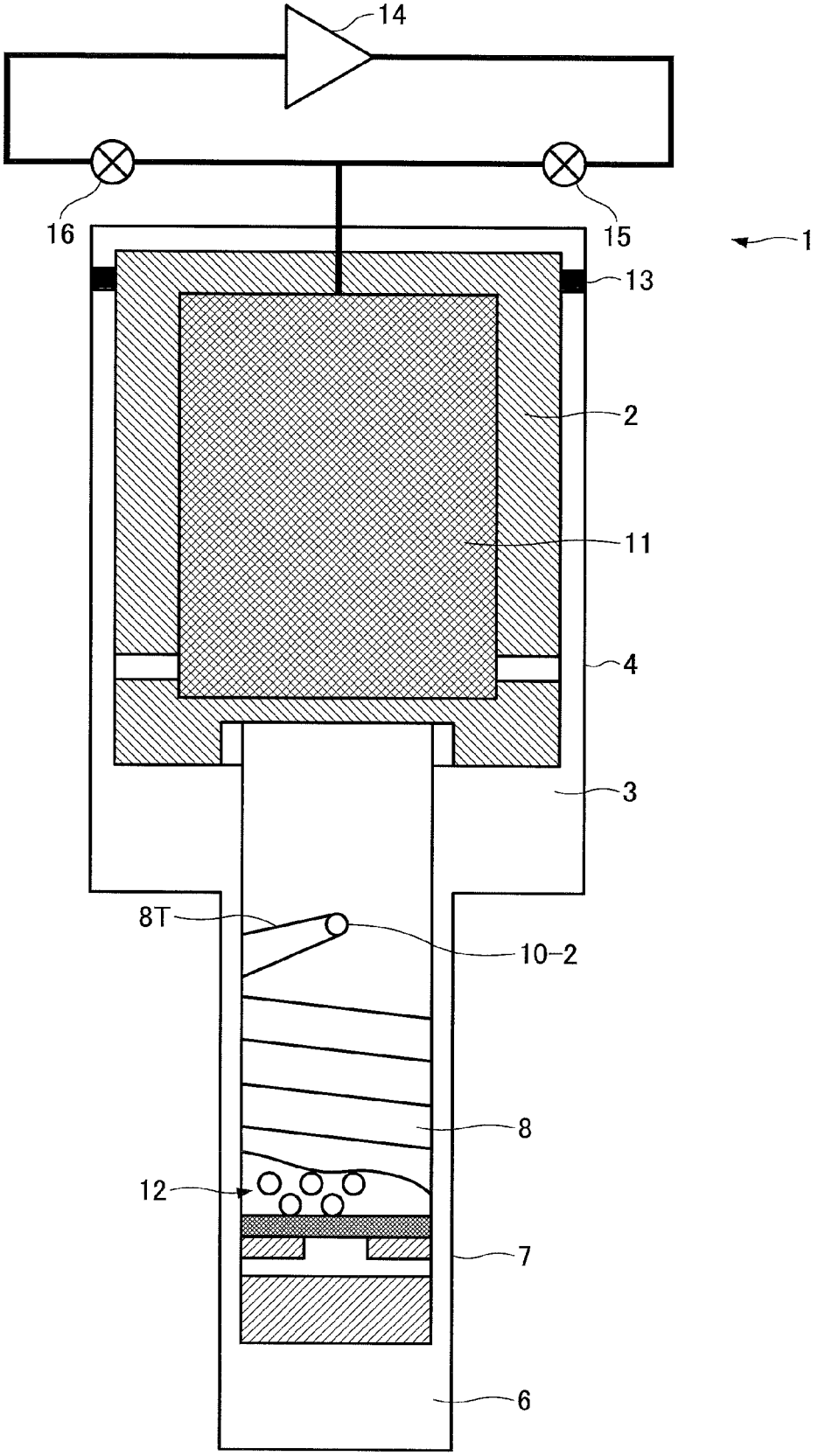
FIG. 5 schematically illustrates an exemplary cryogenic refrigerator of a fourth embodiment.

Referring to FIG. 5, the cryogenic refrigerator 1 includes a helical groove formed on an outer peripheral surface of a second displacer 5 and helically extending from the second expansion space 6, and the flow path 10-2 communicating with the helical groove 8 on the side of a first stage displacer 2. The flow path 10-2 extends in the radius direction of the second stage displacer 5 and communicates with the second regenerator 12. The flow path 10-2 is always positioned on the side of a second expansion space 6 relative to a first expansion space 3. Therefore, the flow path 10-2 is not constantly exposed to the first expansion space 3 regardless of the above reciprocation of the first stage displacer 2 and the second stage displacer 5.

Within the fourth embodiment, a communicating portion 8T communicates with the flow path 10-2 of the helical groove 8. The cross-sectional area of the helical groove 8 perpendicular to a direction along the communicating portion 8T becomes continuously small from the side of the helical groove 8 to the flow path 10-2. Thus, a helium gas smoothly flows at the communication portion 8T.

Within the fourth embodiment, in a manner similar to the first embodiment, the helical groove 8 forming the side clearance between the outer peripheral surface of the second stage displacer 5 and the inner peripheral surface of the second stage cylinder 7 is regarded as a pulse tube refrigerator as illustrated in FIG. 2 to form the virtual gas piston 8P inside the helical groove 8. Then, the flow path 10-2 having the flow resistor is regarded as a double inlet of which phase and length are appropriately adjustable to realize a sealing function with the gas piston 8P. Said differently, a leakage loss is prevented to enhance refrigeration efficiency. Further, a low temperature side space 8L inside the helical groove 8*a* is used as a third expansion space to thereby enhance the refrigeration efficiency.

Further, the flow path 10-2 is also the flow resistor. The cross-sectional area of the flow resistor is made smaller than the cross-sectional area of the helical groove in order to reduce the flow rate coefficient. Further, by reducing the inner diameter of the flow path 10-2 to be smaller than outer diameters of lead spheres as a second regenerative material of the second regenerator 12, the lead spheres are prevented from intruding from an opening in the flow path 10-2 on the side of the second regenerator 12. Thus, lead spheres are prevented from dropping off the outside of the second regenerator 12.

When it is necessary to increase the inner diameter of the flow path 10-2 to be greater than the outer diameter of the second regenerative material, an appropriate drop preventing part having reticulation smaller than the diameters of the lead spheres is provided on the flow path 10-2 on the side of the second regenerator 12.

Although the cryogenic refrigerator described above has the two stages of the displacers, the number of the stages may be appropriately changed to three or the like.

Within the embodiments, the flow resistor 9 and the flow path 10 are shaped like grooves on the outer peripheral surface of the second stage displacer 5 in the axial direction. However, the shape is not limited to the grooves. For example, the flow resistor 9 and the flow path 10 may further extend from the helical groove 8 in the direction of the helical groove 8.

As described, the embodiments provide a cryogenic refrigerator which can reduce the leakage loss in the side clearance and enhance the refrigeration efficiency by using the side clearance as the third expansion space.

As described, within the embodiments, it is possible to securely adjust the length in the axial direction and the phase of the virtual gas piston in using the side clearance as the pulse tube type refrigerator.

All examples and conditional language recited herein are intended for pedagogical purposes to aid the reader in understanding the embodiments and the concepts contributed by the inventor to furthering the art, and are to be construed as being without limitation to such specifically recited examples and conditions, nor does the organization of such examples in the specification relate to a showing of superiority or inferiority of the embodiments. Although the cryogenic refrigerator have been described in detail, it should be understood that the various changes, substitutions, and alterations could be made hereto without departing from the spirit and scope of the invention.

What is claimed is:

1. A cryogenic refrigerator comprising:

a first stage displacer;

a first stage cylinder configured to form a first expansion space between the first stage cylinder and the first stage displacer;

a second stage displacer connected to the first stage displacer; and a second stage cylinder configured to form a second expansion space between the second stage cylinder and the second stage displacer, wherein the second stage displacer includes a helical groove formed on an outer peripheral surface of the second stage displacer so as to helically extend from the second expansion space, a flow resistor communicating with a side of the first stage displacer, including a communication hole extending in a radius direction of the second stage displacer, and causing a side clearance between the outer peripheral surface of the second stage displacer including the helical groove and an inner peripheral surface of the second stage cylinder to communicate with an inside of the second stage displacer, a flow path connecting the flow resistor to a side of the first expansion space, and a communication passage communicating with a regenerator positioned inside the second stage displacer so as to connect the second expansion space to the regenerator, wherein a vertical position of the flow resistor is within an area lower than the first expansion space and upper than the second expansion space so that the flow resistor is always positioned on a side of the second expansion space away the first expansion space.

2. The cryogenic refrigerator according to claim 1, wherein the flow path extends in an axial direction of the second stage displacer on the outer peripheral surface of the second stage displacer, wherein a cross-sectional area of the flow path in a cross-sectional view perpendicular to the axial direction of the flow path is greater than a cross-sectional area of the flow resistor in a cross-sectional view perpendicular to a direction of extending the flow resistor.

3. The cryogenic refrigerator according to claim 2, wherein the cross-sectional area of the flow path continuously increases as a portion of the flow path corresponding to the cross-sectional area is apart from the flow resistor.

4. The cryogenic refrigerator according to claim 2, wherein the flow path has a shape of extending in a radius direction of the second stage displacer and is configured to function as the flow resistor.

* * * * *